US005638836A

United States Patent [19]

Yasuda

[11] Patent Number: 5,638,836

[45] Date of Patent: Jun. 17, 1997

[54] HAIR CLIP

[75] Inventor: Masahiro Yasuda, Higashiosakashi, Japan

[73] Assignee: Kabushiki Kaisha Yasuda Corporation, Osaka, Japan

[21] Appl. No.: 429,696

[22] Filed: Apr. 27, 1995

[30] Foreign Application Priority Data

Feb. 21, 1995 [JP] Japan ..... 7-032279

[51] Int. Cl.[6] ..... A45D 8/22; A45D 8/28

[52] U.S. Cl. ..... 132/279; 132/273; 132/145; 132/278; 132/275

[58] Field of Search ..... 132/277, 278, 132/279, 282, 273, 275, 276, 144, 145, 146, 148

[56] References Cited

U.S. PATENT DOCUMENTS

| | | | |
|---|---|---|---|
| 313,469 | 6/1885 | Thurgar | 132/145 |
| 2,225,454 | 12/1940 | Kayn | 132/145 |
| 2,897,825 | 8/1959 | Wagner | 132/279 |
| 3,412,739 | 11/1968 | Thatcher | 132/278 |
| 3,628,545 | 12/1971 | Moody | 132/148 |
| 5,109,878 | 5/1992 | Kuo-Hua | 132/278 |
| 5,323,793 | 6/1994 | Lorenzi | 132/145 |
| 5,365,955 | 11/1994 | Desgroux et al. | 132/279 |

*Primary Examiner*—Gene Mancene
*Assistant Examiner*—Pedro Philogene
*Attorney, Agent, or Firm*—Armstrong, Westerman, Hattori, McLeland & Naughton

[57] ABSTRACT

A hair clip has a base plate (1, 101) having comb-tooth-shaped lugs (4, 104), and also has a hair retainer (2, 102) connected to the base plate. The hair retainer has one end engageable with and disengageable from one end of base plate. The lugs (4, 104) are effective to render the hair clip more retentive on the user's hair. The hair retainer (2, 102) can swing or slide relative to the base plate (1, 101) so as to expose and use the comb-tooth-shaped lugs (4, 104) as a hair brush or as a comb, with the hair retainer then serving as a handgrip.

13 Claims, 12 Drawing Sheets

HAIR CLIP

BACKGROUND OF THE INVENTION AND RELATED ART

The present invention relates to a hair clip, and more particularly relates to a hair clip comprising a base plate and a hair retainer connected thereto to clip human hairs between the base plate and the hair retainer.

The prior art hair clips of this kind generally comprise an ornamental base plate somewhat curved inwardly and having one end pivoted to a hair retainer. The hair retainer is always elastically urged towards the base plate so that a human hair is gripped between the hair retainer and the base plate.

Thus, the prior art hair clips each serving also as a hair ornament are fundamentally designed to bind the hair up at any desired portion of the user's head.

Such a simple gripping mechanism of the base plate cooperating with the hair retainer is however not necessarily sufficient to prevent the hair clip from slipping down or skewing.

The prior art hair clips serving as a hair binding ornament do not have any other function.

OBJECTS AND SUMMARY OF THE INVENTION

Therefore, an object of the present invention is to provide a hair clip of a novel type such that the hair can more surely hold the hair clip in place, wherein the hair clip has additional uses other than the basic function of binding a hair.

In principle, the hair clip provided herein does comprise a base plate whose back surface having a number of comb-tooth-shaped lugs. A hair retainer connected to the base plate such that the lugs as a whole can function as a hair brush or a comb (hereinafter inclusively referred to as 'hair brush').

In a first mode of the present invention, the hair clip comprises a base plate, a hair retainer having one end pivoted to one end of the base plate, a locking member formed at and integral with the other end of the base plate, a lockable member formed at and integral with the other end of the hair retainer, the lockable member capable of engaging with and disengaging from the locking member, and a plurality of comb-tooth-shaped lugs secured to a back surface of the base plate, wherein the hair retainer is reversibly swingable away from the base plate up to a limit angle so that the plurality of comb-tooth-shaped lugs as a whole are usable as a hair brush.

In order to enable the hair retainer to serve as a handgrip, the limit angle may substantially be 180 degrees and the hair retainer may desirably be prevented from further rotating over the limit angle.

The hair retainer pivoted to the one end of the base plate may be displaceable a distance in opposite directions longitudinally of base plate, so that the locking member can releasably lock the lockable member.

The locking member at the one end of the base plate may be lower than the comb-tooth-shaped lugs in order to ensure a smoother action thereof to brush the hair.

In the normal use of the hair clip, the user's hair will be gripped between the base plate and the hair retainer, as in the prior art hair clips. In this state, each comb-tooth-shaped lug protruding from the back surface of the base plate is placed in between hairs, whereby the hair clip of the invention is fixedly attached to the user's hair not to move or skew relative thereto.

In another use, the hair retainer will be stretched and substantially aligned with the base plate so as to expose and use the comb-tooth-shaped lugs, wherein the hair retainer may be usable as a handgrip.

In a second mode of the present invention, the hair clip comprises a base plate, upright legs protruding from and perpendicular to the base plate, a hair retainer having a basal end and a shaft secured thereto and pivoted to the upright legs at one end of the base plate, a locking member formed at and integral with the other end of the base plate, a lockable member formed at and integral with the other end of the hair retainer, the lockable member capable of engaging with and disengaging from the locking member, a plurality of comb-tooth-shaped lugs secured to a back surface of the base plate, wherein the hair retainer is reversibly swingable away from the base plate up to a limit angle where the hair retainer and the base plate are included in substantially the same plane, a lock mechanism comprising recesses for a sliding engagement with the basal end of the hair retainer, the recesses being formed in basal portions of the upright legs and partially defined with the back surface of base plate so as to open towards the aforementioned one end thereof and extend a distance along the base plate, such that the basal end of the hair retainer pivoted to the base plate is capable of sliding towards the base plate when included in substantially the same plane as the base plate, until the basal end comes into a full engagement with the recesses so as to inhibit the hair retainer from swinging relative to the base plate. The lock mechanism functions to stabilize the fully opened position of the hair retainer, whereas the locking and lockable members function to hold in place the hair retainer at its closed position.

With the hair retainer being swung and subsequently locked in place, the plurality of comb-tooth-shaped lugs as a whole are usable as a hair brush and the hair retainer can serve as a handgrip therefor.

Alternatively, the locking member and lockable member may be such that the hair retainer is locked when it has slided a distance towards the one end of the base plate, and is unlocked when it has been slided towards the other end of the base plate.

It is preferable that an extremity of the basal end of the hair retainer bears against the base plate's portion located near the shaft of said hair retainer, so that the latter is inhibited from further swinging, when and after it has swung from its closed position located in juxtaposition with the back side of the base plate.

In a third mode of the present invention, the hair clip comprises a base plate, a plurality of comb-tooth-shaped lugs secured to a back surface of the base plate, a hair retainer for cooperating with the base plate to grip a human hair, a connector protruding from the back surface and integral with one end of the base plate, the connector unremovably engaging with the hair retainer, a locking member formed at and integral with other end of the base plate so as to fix thereto one end of the hair retainer, a slot formed in and along the hair retainer, the slot being intermediate lateral edges of said hair retainer, the connector being held in engagement with the slot such that the hair retainer is slidable between a retracted position and an extended position, wherein the retainer fully overlaps with the base plate at the retracted position and fully extends outwardly from the one end of the base plate at the extended position, and a recess formed in the connector such that the one end of the hair retainer taking the extended position is locked in place not to swing relative to the base plate.

With the hair retainer having been slided along the base plate to the extended position and then locked there, the plurality of comb-tooth-shaped lugs secured to the bask surface of the base plate will be exposed. In this state, the plurality of comb-tooth-shaped lugs as a whole are usable as a hair brush and the hair retainer can serve as a handgrip therefor.

It is preferable that the connector has integral therewith outer lugs protruding sideways beyond lateral and parallel edges of the slot, so that the lugs cooperate with the base plate's edge to prevent the hair retainer from rocking beyond an angular limit relative to the base plate.

In any mode of the invention, the user's hair will be gripped between the base plate and the hair retainer, as in the prior art hair clips. In this state, each comb-tooth-shaped lug protruding from the back surface of the base plate is placed in between hairs, whereby the hair clip of the invention is fixedly attached to the user's hair not to move or skew relative thereto.

DESCRIPTION OF THE PREFERRED EMBODIMENTS

Figure 1:
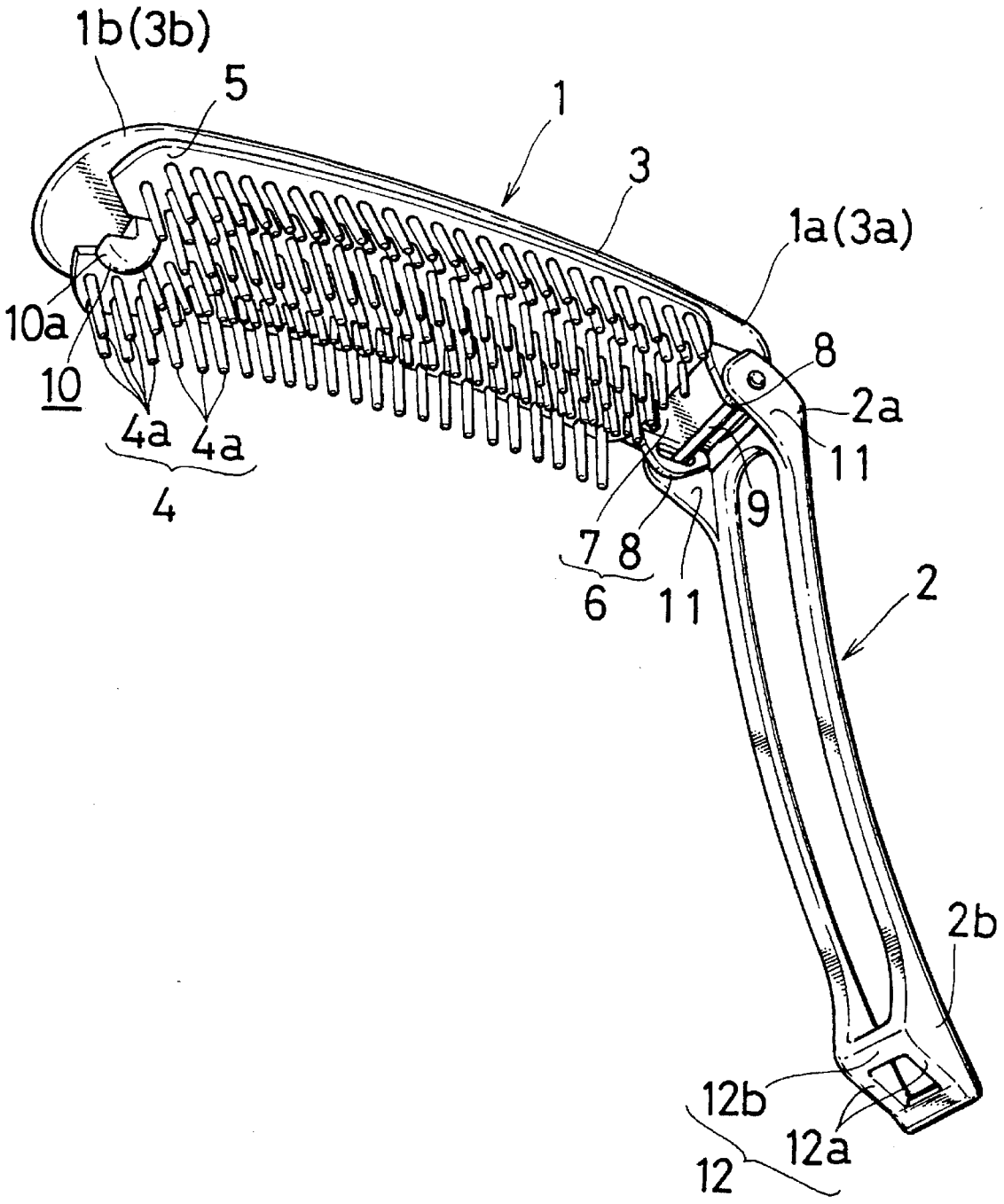
FIG. 1 is a perspective view of a hair clip provided in a first embodiment of the invention, in a state in which a hair retainer of the hair clip is being opened away from a base plate thereof.

The present invention will now be described in detail referring to the drawings.

FIRST EMBODIMENT

A hair clip provided in an embodiment comprises a base plate 1 having one end 1*a* to which a hair retainer 2 is pivoted. A user's hair will be gripped by and between the base plate 1 and hair retainer 2.

A main body of the base plate is formed as an ornamental cover 3 made of a hard plastics. This cover is somewhat curved inwardly towards the hair retainer. Secured to the back surface of said decorative strip 3 are a plurality 4 of comb-tooth-shaped lugs 4*a*.

The main body of base plate 1 may alternatively consist of a metal plate and a decorative member attached to the front surface thereof.

The ornamental cover 3 as the base plate 1 has a pivoting member 6 at its one end 3*a*, and the hair retainer 2 is hinged to this member.

Figure 5:
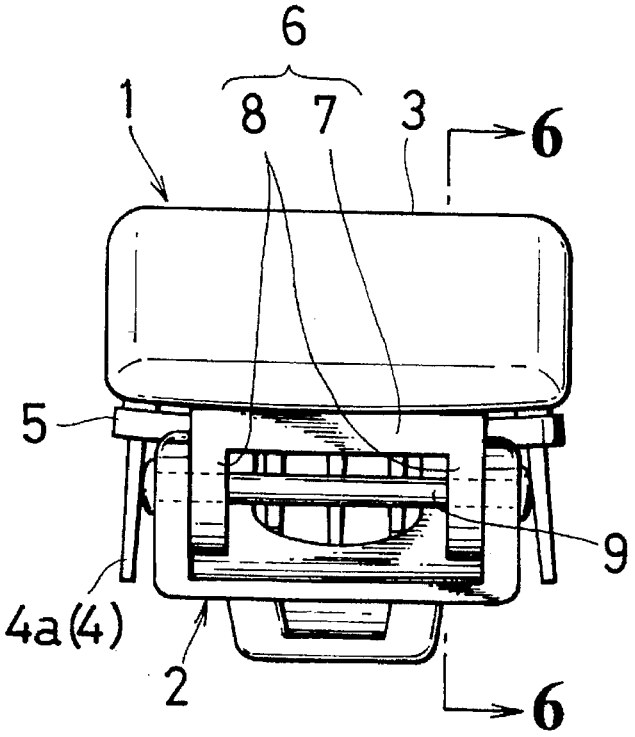
FIG. 5 is an enlarged right side elevation of the hair clip.
Figure 6:
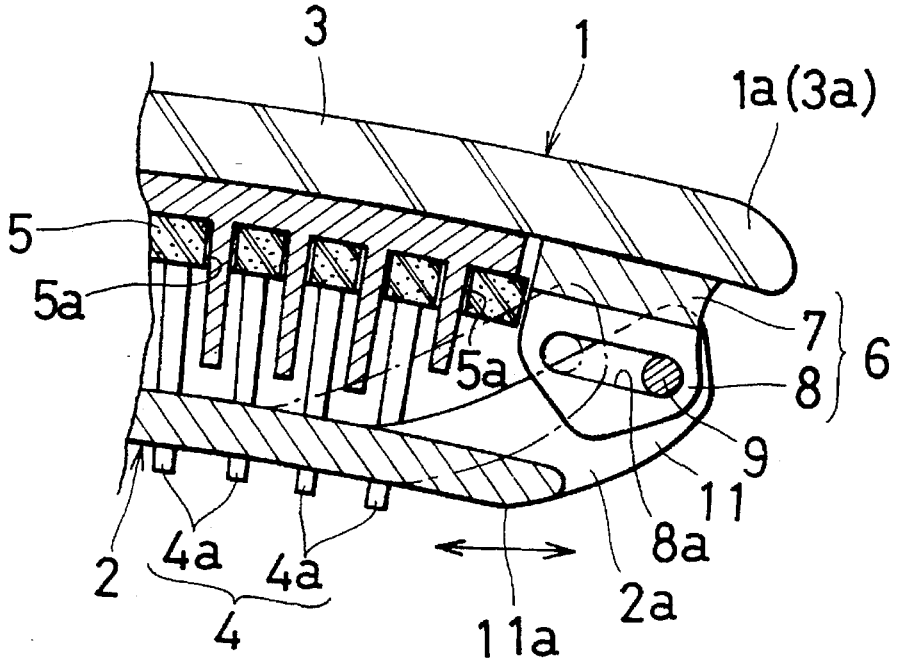
FIG. 6 is an enlarged cross section taken along the line 6—6 in FIG. 5.

As shown in FIGS. 5 and 6, the pivoting member 6 comprises a short bar 7 fixed to the cover, wherein this bar lies transversely of and in parallel with the cover 3. A pair of upright legs 8 are integral with the bar 7 so that the member 6 is U-shaped in cross section in its entirety. Slots 8*a* formed through the legs 8, at portions thereof facing one another. Each slot 8*a* extends longitudinally of the ornamental cover 3 so that a shaft 9 having its opposite ends inserted in the slots can move a given distance along said cover.

Alternatively, the pivoting member 6 may be formed as an integral portion of the ornamental cover 3, wherein the legs will directly protrude therefrom.

Figure 7:
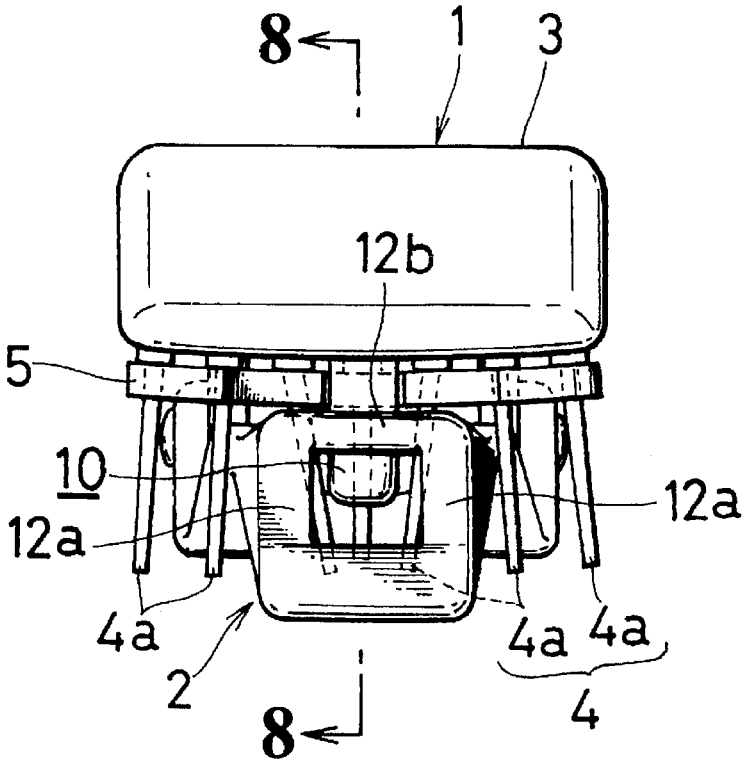
FIG. 7 is an enlarged left side elevation of the hair clip.
Figure 8:
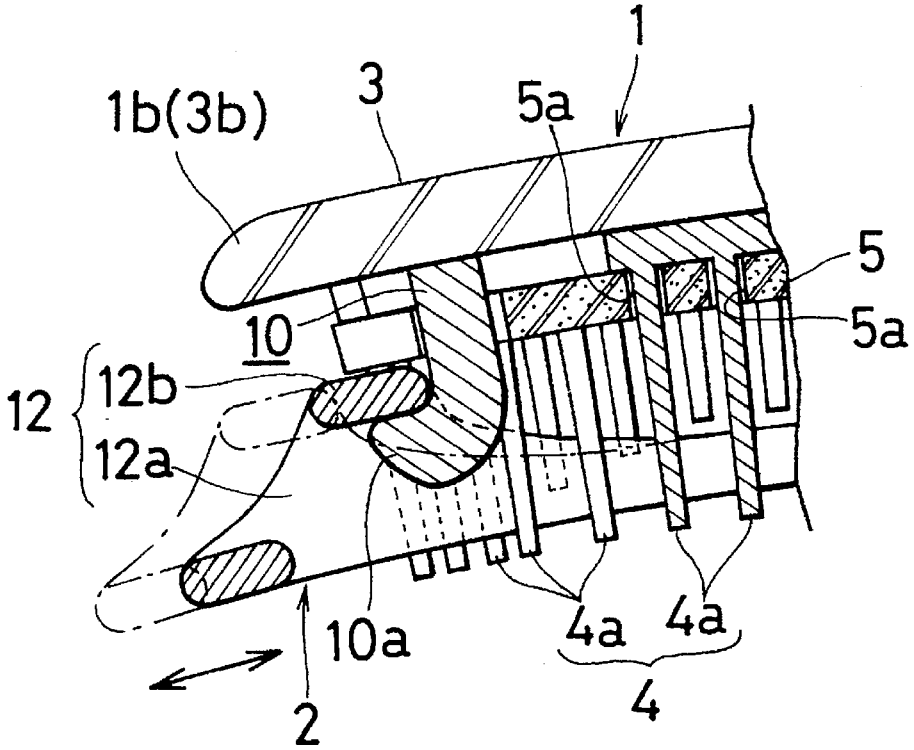
FIG. 8 is a cross section taken along the line 8—8 in FIG. 7.

A locking member 10 is disposed at the other end 3*b* of the back surface of the ornamental cover 3. In use of this hair clip, the other end 2*b* of hair retainer 2 will releasably be retained by the locking member, which has a hook 10*a* facing said other end 3*b* as best seen in FIGS. 7 and 8.

FIG. 1 shows that the plurality of comb-tooth-shaped lugs 4*a* are distributed over the back surface of ornamental cover 3, except for opposite ends thereof. Those lugs 4*a* form seven rows each extending longitudinally of the cover, thus they are arranged at regular intervals transversely of said cover. Alternatively, all the lugs 4 may form a single row.

In use, each lug 4*a* will come in between the hairs of a user so that the friction between the hair clip and the hairs increases. The hair clip thus almost immovably attached to the hairs is prevented from moving or skewing relative thereto. On the other hand, the hair retainer in this hair clip may be opened to be ready for secondary uses. The lugs 4*a* in several rows will allow this hair clip to work as if it were a hair brush, while the single row of said lugs will render it usable as a comb.

The plurality 4 of the comb-tooth-shaped lugs 4*a* may form a discrete member attached to the ornamental cover 3, or alternatively be integral with the base plate 1 or with the ornamental cover 3 thereof.

FIG. 8 shows that the locking member 10 is lower than the lugs 4*a*, for a better and smooth operation thereof when used as the brush.

An antislip mat 5 is secured to a base sheet from which the comb-tooth-shaped lugs 4*a* protrude. This mat made of a frictional rubber or soft plastic and covering the whole surface of said base sheet has a number of small holes 5*a*. Each lug 4*a* penetrates one such hole formed through the mat. This antislip mat 5 will exert a frictional resistance to the hairs which tend to move relative to the mat. Thus, the hair clip will be more strongly retained on the user's hair, not to move or skew relative thereto. The mat may not necessarily cover the whole surface, but be of a smaller size insofar as a sufficient frictional resistance is ensured.

It is however noted that such an antislip mat 5 may be dispensed with, because the comb-tooth-shaped lugs 4*a* protruding from the back surface of the ornamental cover 3 are usually effective to keep the hair clip on the user's hair.

An excessively strong frictional resistance of the antislip mat 5 will possibly hinder the plurality of lugs 4*a* from smoothly combing the user's hair. Therefore, the mat 5 has to be made of a proper material to realize a good balance between the mat and the hair, regarding the frictional resistance.

The hair retainer 2 hinged to the base plate 1 may be a piece of hard plastics, or of a metal or the like.

As shown in FIG. 1, the retainer 2 is preferably a frame-shaped member composed of two parallel bows and of a size corresponding to the base plate, and has at its one end 2*a* a pair of arms 11 integral therewith and corresponding to the legs 8 of the pivoting member 6. Inner surfaces of those arms 11 fit on the outer surfaces of the legs 8. The opposite ends of the shaft 9 penetrate the arms 11, so that the hair retainer 2 can swing around the shaft and move the given distance along the base plate 1.

Figure 2:
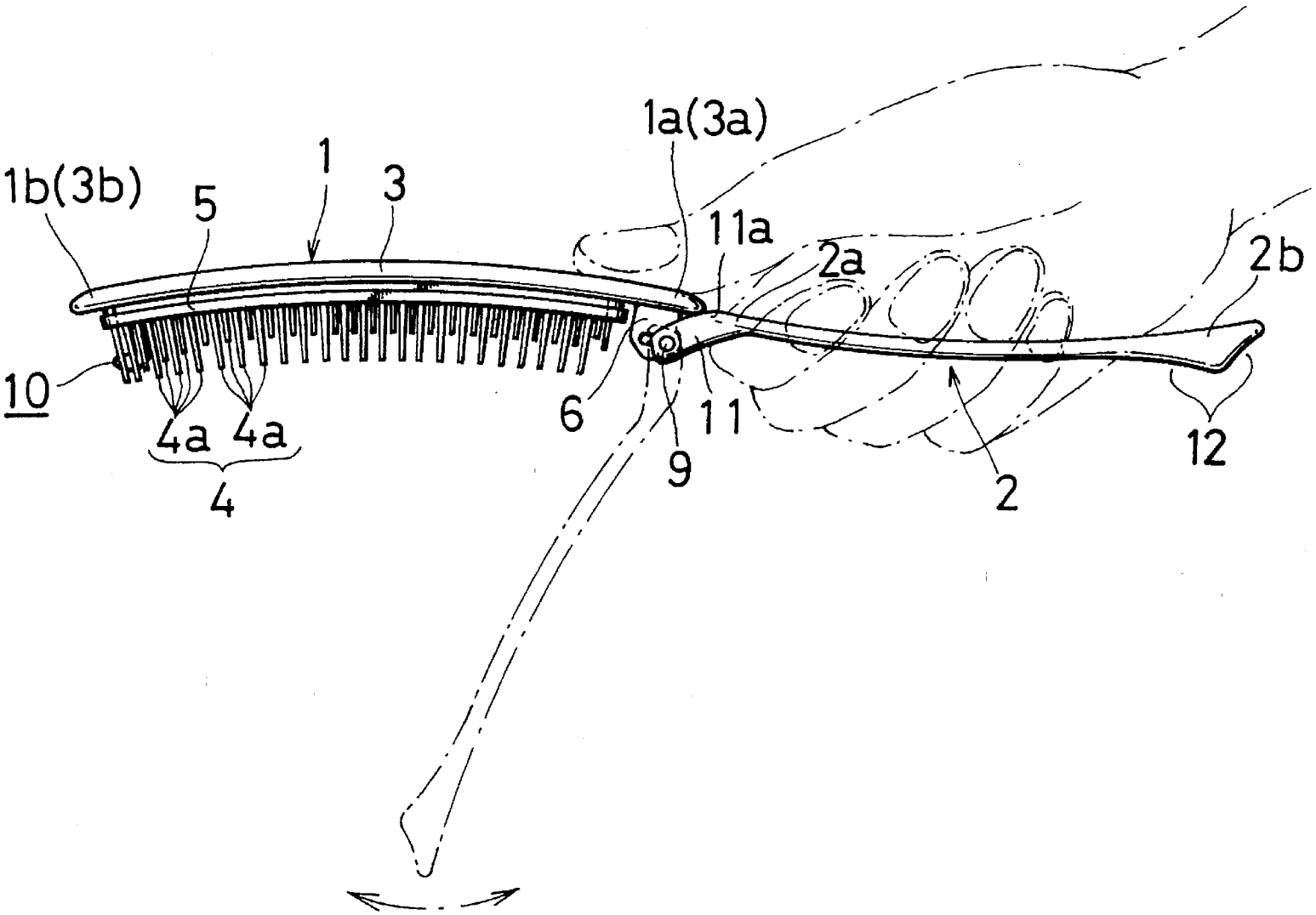
FIG. 2 is a front elevation of the hair clip shown in another state thereof in which the hair retainer has been opened fully.

The solid lines in FIG. 2 show the hair retainer 2 having rotated in a direction away from the base plate to open at a maximum angle such that it is aligned with the base plate 1. The hair retainer is prevented from further rotating in the same direction, because a bulged portion 11*a* of each arm 11 abuts against the back surface of the ornamental cover 3. The hair retainer 2 having fully opened will serve as the handgrip when the plurality 4 of lugs 4*a* are used as one hair brush. Thus, the fully opened hair retainer 2 preferably takes its fully opened position substantially in alignment with the base plate 1. The maximum rotation angle is not necessarily limited to 180 degrees, so long as the lugs 4*a* as a whole can work as one hair brush.

It is further desirable that the hair retainer 2 is releasably locked at its fully opened position, to be immovable relative to the base plate 1. Such a locking structure will allow the hair retainer to work as if it were a real handgrip.

The other end 2*b* of the hair retainer 2 has a lockable member 12 engageable with and disengageable from the locking member 10 of the base plate 1.

As seen in FIGS. 1, 7 and 8, the lockable member 12 may consist for example of a pair of side bulged portions 12*a* protruding towards the base plate and a transverse tie bar 12*b* connecting the summits of those bulged portions to each other.

As the solid lines in FIG. 8 illustrate, after the hair retainer 2 is swung reversely towards the base plate 1 so as to take a position in parallel with and overlapping the latter, said retainer will be displaced towards the one end 1*a* of the base plate until the tie bar 12*b* is caught by the hook 10*a* of the aforementioned locking member 10. This locking state of the hair retainer 2 can easily be broken by sliding it in a reverse direction.

It will be understood that the combination of the locking member 10 with lockable member 12 as exemplified above may be replaced with any other suitably modified mechanism, provided that the latter functions substantially in the manner to give the same effect.

Figure 3:
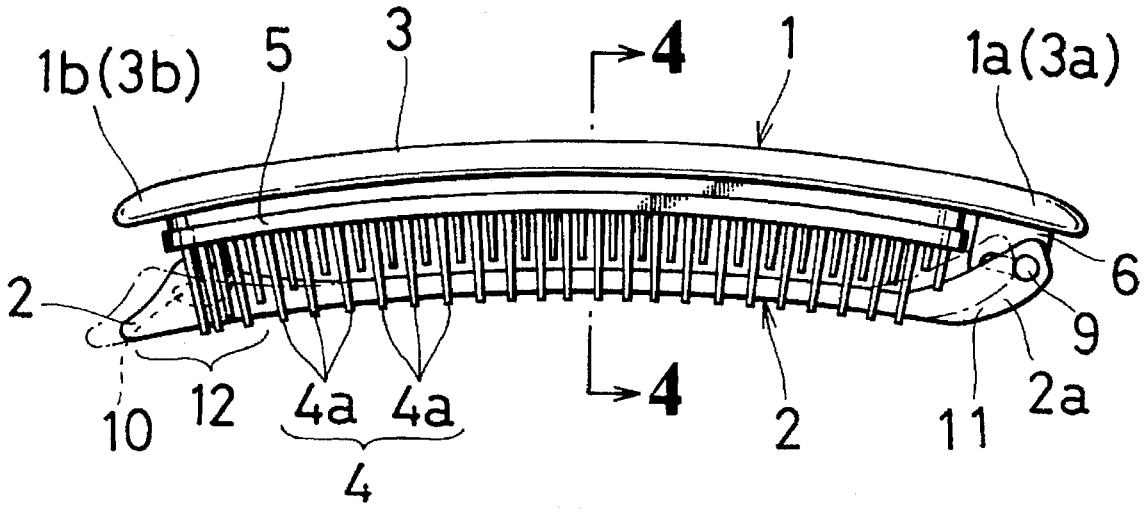
FIG. 3 is a front elevation of the hair clip shown in a further state in which the hair retainer is closed and a lockable member thereof is in engagement with a locking member of the base plate.
Figure 4:
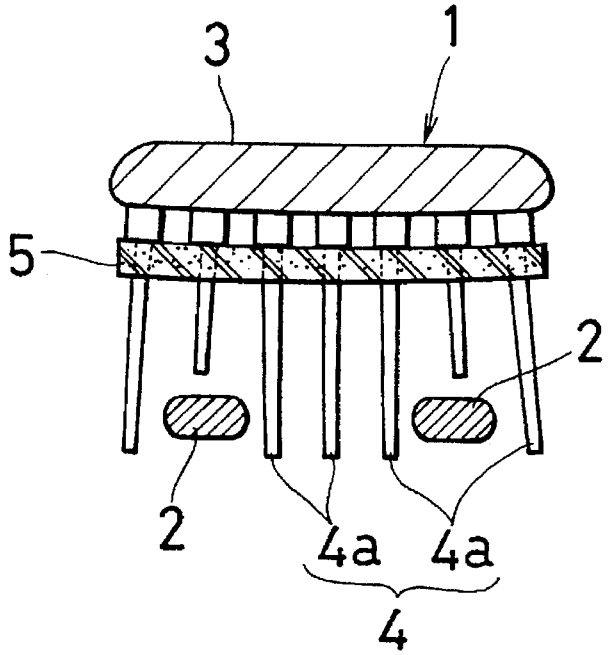
FIG. 4 is an enlarged cross section taken along the line 4—4 in FIG. 3.

FIGS. 3 and 8 show that the hair retainer 2 has its longitudinal intermediate portion lying low in the lugs 4*a*, when closed and locked. Such a low position of retainer affords a surer retention of this hair clip on the hair. As shown in FIG. 4, the lugs 4*a* in some rows facing the retainer 2 are designed shorter than the others in other rows, for the retainer to take the low hidden position. Alternatively, the lugs 4*a* in all the rows may be of the same length such that each bow of the hair retainer 2 gets in between the adjacent rows of lugs.

It will now be apparent that the hair clip having its base plate 1 cooperating with the hair retainer 2 is held not to move or skew on the user's hair, thanks to entanglement thereof with the lugs 4*a* and due to frictional resistance of the antislip mat 5.

As already mentioned above, the hair retainer 2 locked at its opened position can serve, as shown with solid lines in FIG. 2, as a handgrip of a hair brush comprising the plurality 4 of the comb-tooth-shaped lugs 4*a*.

The structure of the hair clip provided herein can be modified so long as a plurality of comb-tooth-shaped lugs protrude from the back surface of a base plate and a hair retainer is openable away from the base plate so as to function like a handgrip in any hair brush.

The present hair clip comprising the base plate and the hair retainer pivoted thereto at one end and lockable thereto at the other end can be used in the same manner as the prior art hair clips.

The plurality of lugs each jammed between the adjacent hairs render the hair clip more retentive not to unintentionally move or skew on the user's hair.

The hair retainer swung to open and kept at a necessary and sufficient angle relative to the base plate becomes a handgrip, when the hair clip is used as a hair brush.

The users of this hair clip which can more surely grip the user's hair and has such a hair retainer need no longer to carry any hair brush or the like.

Since the hair retainer can be swung to and held at its position substantially flush with the base plate, it is convenient for the users to make use of the hair retainer as a handgrip of hair brush.

Since the hair retainer pivoted at one end to the base plate is slidable relative thereto, the displacement of said hair retainer in one direction towards the one end causes the lockable member to engage with the locking member so as to maintain the hair retainer at its closed position on the user's hair, and reverse displacement in the opposite direction brings these members out of engagement so that the hair retainer can be opened and swung to take its stretched position.

The locking member protruding from the base plate is lower than the comb-tooth-shaped lugs, so that a smooth operation thereof as a hair brush is assured.

SECOND EMBODIMENT

FIGS. 9 to 13 show the second embodiment.

A lock mechanism 'L' is a characteristic feature of the hair clip provided in this embodiment. However, the general structure of this hair clip is the same as or similar to that of the hair clip already described in the first embodiment. Description of those members and elements to which the same reference numerals as those in the first embodiment are allotted is not repeated.

Figure 9:
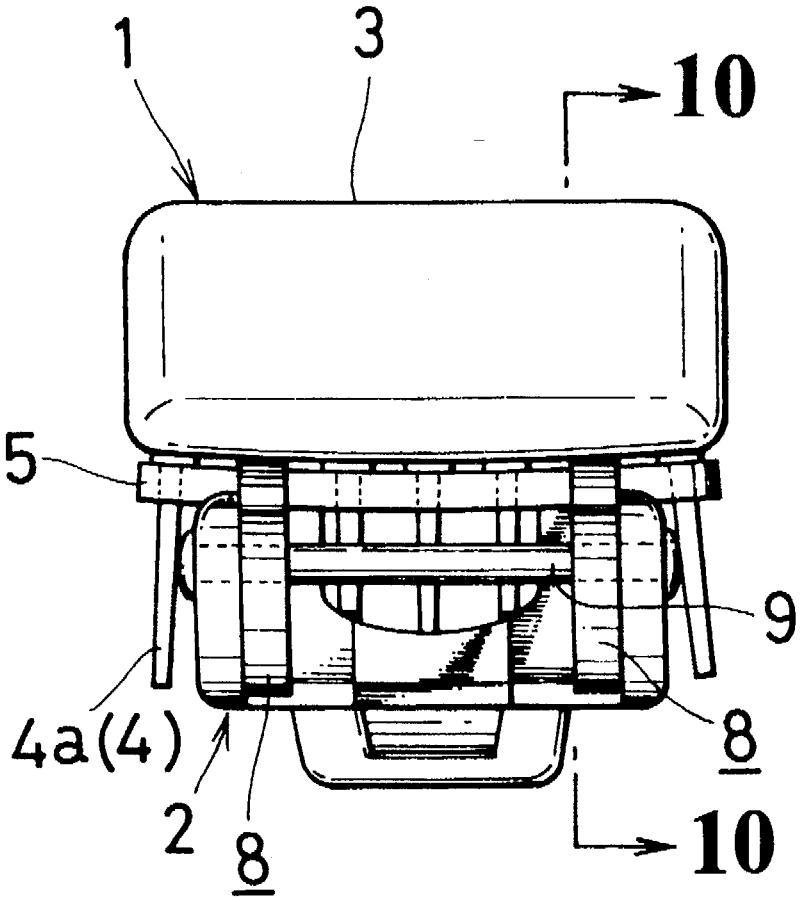
FIG. 9 is an enlarged right side elevation of a hair clip in a second embodiment.
Figure 10:
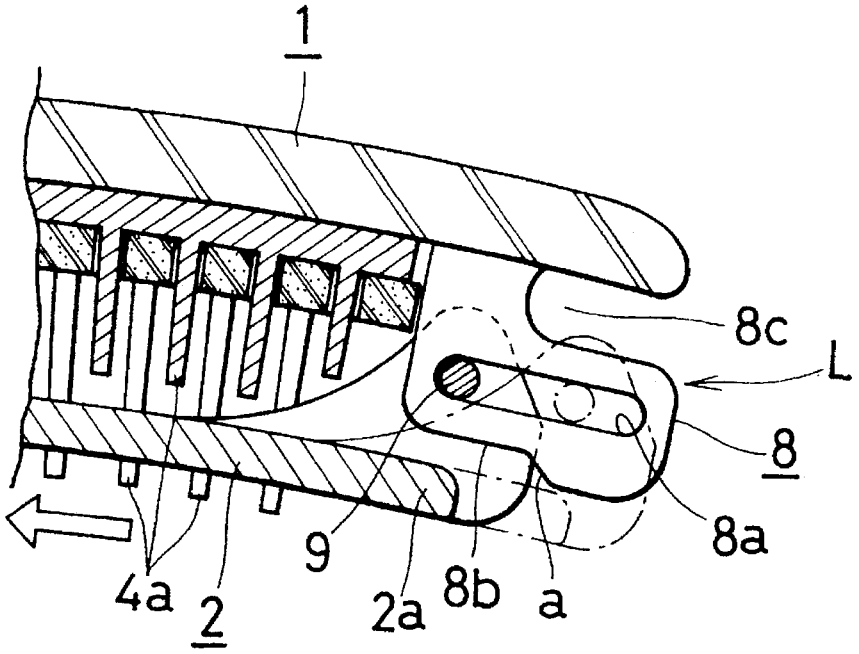
FIG. 10 is an enlarged cross section taken along the line 10—10 in FIG. 9.

The upright legs 8 for pivoting the hair retainer 2 in the second embodiment are spaced a distance and extend in parallel with each other. Those legs 8 however protrude directly from the back surface of one end of the ornamental cover 3 serving as the base plate 1, as shown in FIG. 9.

Figure 11:
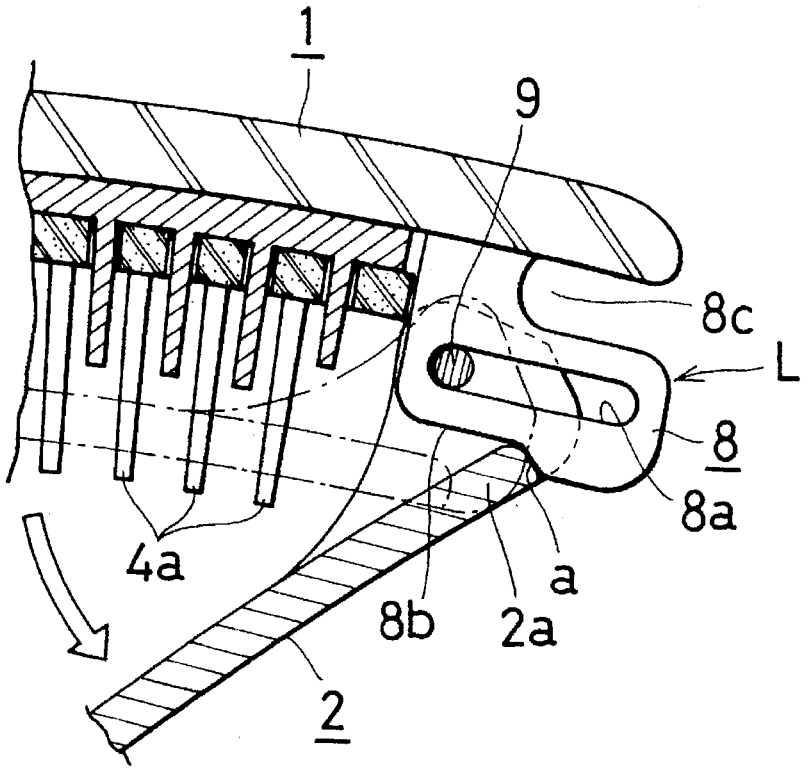
FIG. 11 is an enlarged cross section corresponding to FIG. 10, with a hair retainer of the hair clip being swung.

FIG. 11 shows that the hair retainer 2 at its closed position is inhibited from swinging in situ beyond an angular limit towards its opened position. This is because an edge of the basal end 2*a* of the hair retainer 2 is stopped by shoulders 'a' formed in the lower surfaces 8*b* of the upright legs 8. Such a limited swingable angle enables this hair clip to be attached to the user's hair easily and surely.

Figure 12:
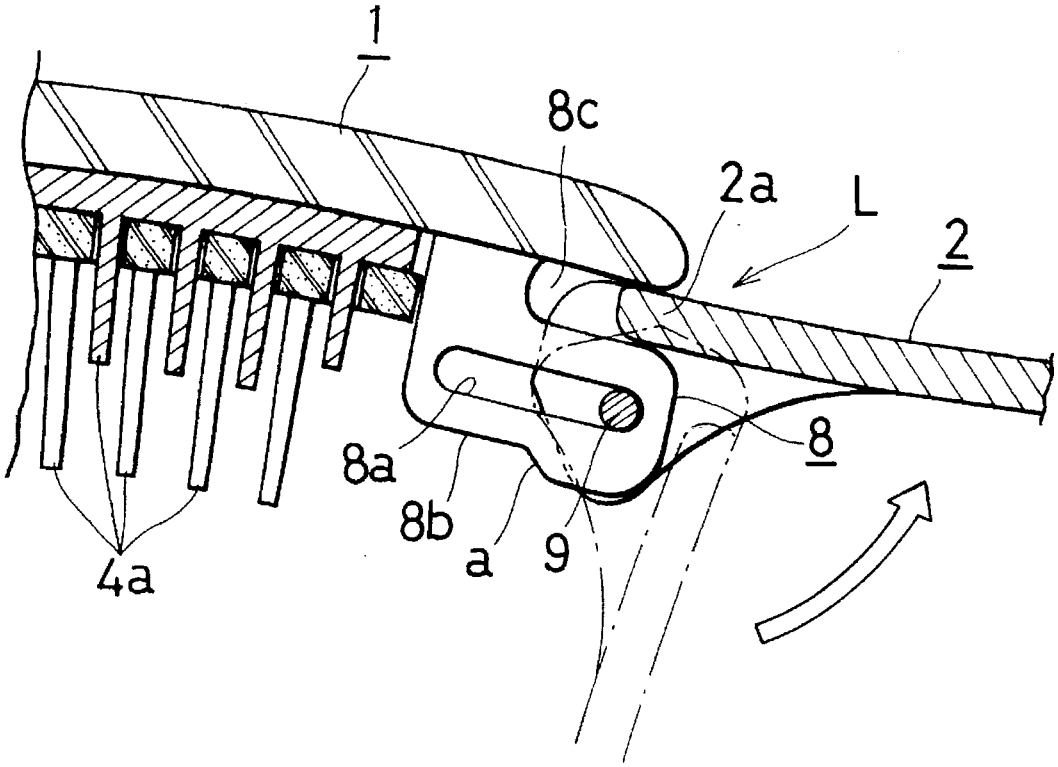
FIG. 12 is an enlarged cross section corresponding to FIG. 10, with the hair retainer having been swung so as to be included substantially in the same plane as a base plate of the hair clip.
Figure 13:
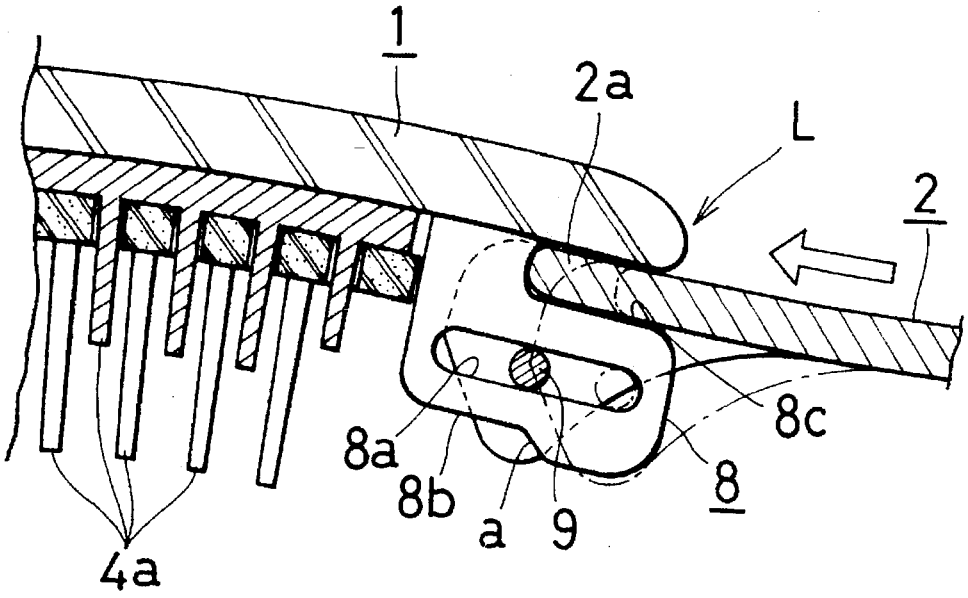
FIG. 13 is an enlarged cross section corresponding to FIG. 10, wherein the hair retainer swung to its position shown in FIG. 12 has been displaced straight and backwards a distance towards the base plate so as to take a locked position.

The dash-and-dot in FIG. 12 shows that the shaft 9 of the hair retainer 2 is slidable within the elongate slots 8*a* formed in the legs 8, so as to move towards one end of the base plate. The solid lines in FIG. 12 show that once the hair retainer 2 has slided to take its extreme position nearest to the one end of the base plate 1, it is possible to swing the hair retainer beyond the aforementioned angular limit, in a direction indicated at the white arrow. The hair retainer can thus take its position included substantially in the same plane as the base plate. However, the hair retainer 2 is prevented from further swinging in said direction across the said plane.

The lock mechanism 'L' referred to above is constructed such that the hair retainer 2 having swung to the position substantially flush with the base plate 1 can temporarily be brought into a locked state in which the hair retainer cannot swing in any direction.

In detail, the basal end 2*a* of the hair retainer 2 is pivoted to and slidable relative to the upright legs 8 and longitudinally of the base plate 1. Recesses 8*c* for a sliding engagement with the basal end 2*a* are formed in basal portions of the upright legs 8, and partially defined with the back surface of base plate 1 so as to open towards the aforementioned one end thereof. The recesses 8*c* extend a distance along the base plate, such that the basal end 2*a* of the hair retainer 2 pivoted to the base plate 1 and included in a plane located close to and in parallel with the base plate can slide towards the base plate, until the basal end 2*a* comes into a full engagement with the recesses 8 so as to inhibit the hair retainer 2 from swinging relative to the base plate.

The hair retainer 2 thus locked at its opened position can serve as a handgrip of a hair brush comprising the plurality 4 of the comb-tooth-shaped lugs 4*a*.

It will now be apparent that the hair clip having its base plate 1 cooperating with the hair retainer 2 is held not to move or skew on the user's hair, thanks to entanglement thereof with the lugs 4*a* and due to frictional resistance of the antislip mat 5.

The users of this hair clip which can more surely grip the user's hair and has such a hair retainer need no longer to carry any hair brush or the like.

THIRD EMBODIMENT

FIGS. 14 to 19 show the third embodiment of the present invention.

A hair clip provided in this embodiment also comprises a base plate 101, a plurality of comb-tooth-shaped lugs 104 secured to a back surface of the base plate, and a hair retainer 102 for cooperating with the base plate to grip a human hair.

The base plate 101 is a plate serving as an ornamental cover 103 and made of a hard plastics is slightly curved towards the hair retainer.

A connector 108 protruding from one end 103*a* of the back surface of the ornamental cover 103 is firmly secured thereto (thus to one end 101*a* of the base plate 101). The connector 108 unremovably engaging with the hair retainer 102 and made of a hard plastics extends substantially in parallel with the base plate 101.

A locking member 110 formed at and integral with the back surface of other end of the base plate so as to fix thereto one end 102*b* of the hair retainer 102. The locking member 110 has a hook 110*a* facing the other end 103*b* of the ornamental cover 103, as in the preceding embodiment.

Figure 14:
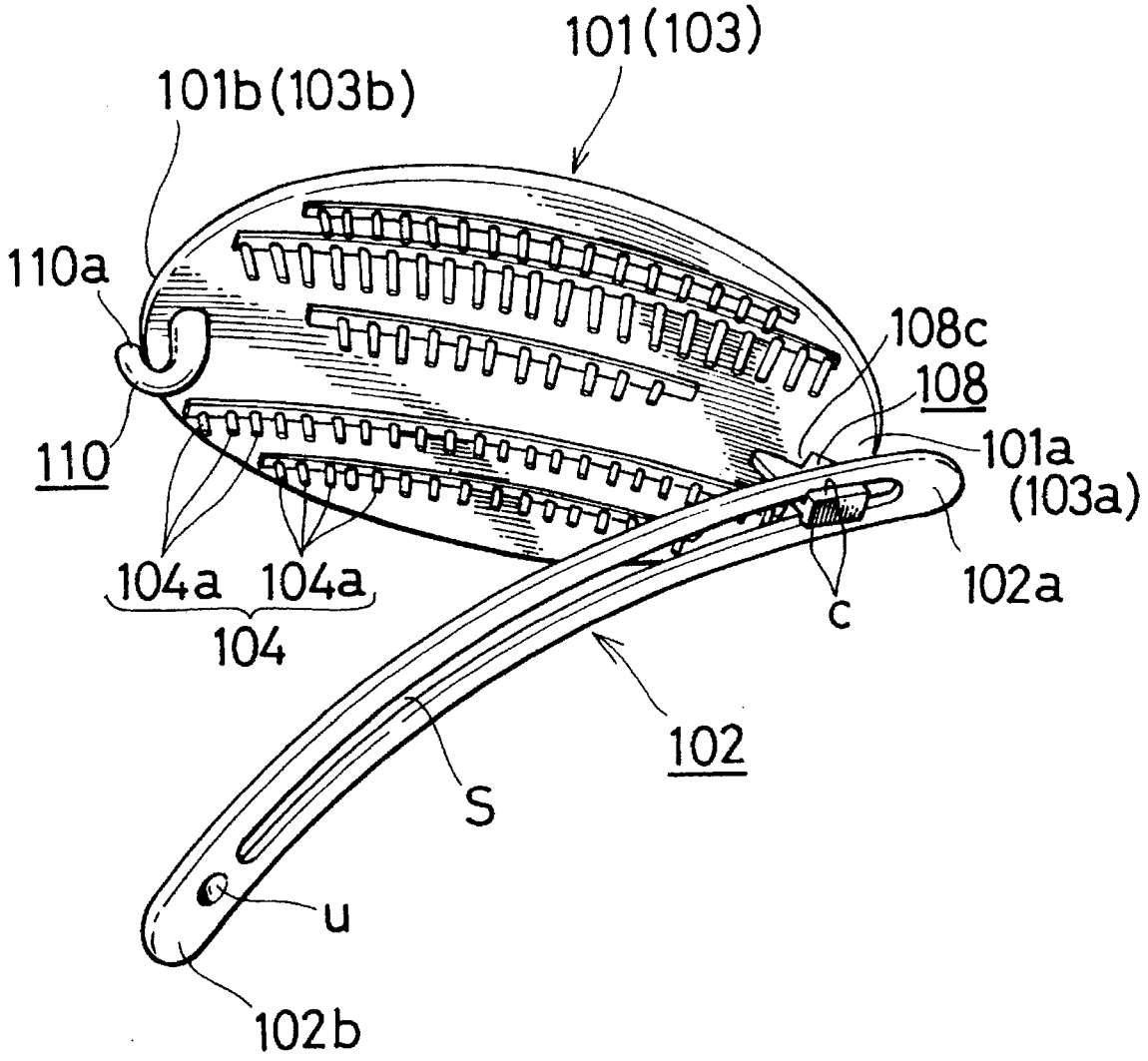
FIG. 14 is a perspective view of a hair clip in a third embodiment, in which a hair retainer of the hair clip is unlocked and released from a base plate thereof.

The comb-tooth-shaped lugs 104*a* protruding from the cover 103 are distributed uniform over entire back surface thereof, except for the said ends, as shown in FIG. 14. The lugs 104*a* in this embodiment are arranged in several rows, each extending longitudinally of the cover 103, similarly to the preceding embodiment. Those rows are spaced a predetermined distance from each other transversely of the cover. Alternatively, all the lugs 104*a* may form a single row.

In use, the plurality 104 of lugs 104*a* will come each in between the hairs of a user so that the friction between the hair clip and the hairs increases. On the other hand, the hair retainer 102 in this hair clip may be opened to be ready for secondary uses. The lugs 104*a* forming the several rows will allow this hair clip to work as if it were a hair brush, while the single row of said lugs 104*a* will render it usable as a comb.

The plurality 104 of the comb-tooth-shaped lugs 104*a* may be provided as a discrete member which is attached to the ornamental cover 103 as in this embodiment, or alternatively be integral with the base plate 101 or with the ornamental cover 103 thereof.

An antislip mat similar to that in the first embodiment may also be employed in this embodiment. The comb-tooth-shaped lugs 104*a* will have their basal ends embedded in said mat, which may be made of a frictional rubber or soft plastic and may cover substantially whole back surface of said base plate.

As shown in FIG. 14, the hair retainer 102 belt-shaped and made of a hard plastics has a slot 'S' formed in and along the hair retainer. This slot slightly longer than the base plate 101 is located intermediate the lateral edges of the hair retainer, and extends over the full length not including the opposite ends of said retainer 102.

The connector 108 is held in a sliding engagement with the slot 'S' such that the hair retainer 102 can move between its retracted position and its extended position. The hair retainer 102 will fully overlap with the base plate 101 at the retracted position, and will fully extends outwardly from the one end 101*a* of the base plate 101 at the extended position.

Figure 15:
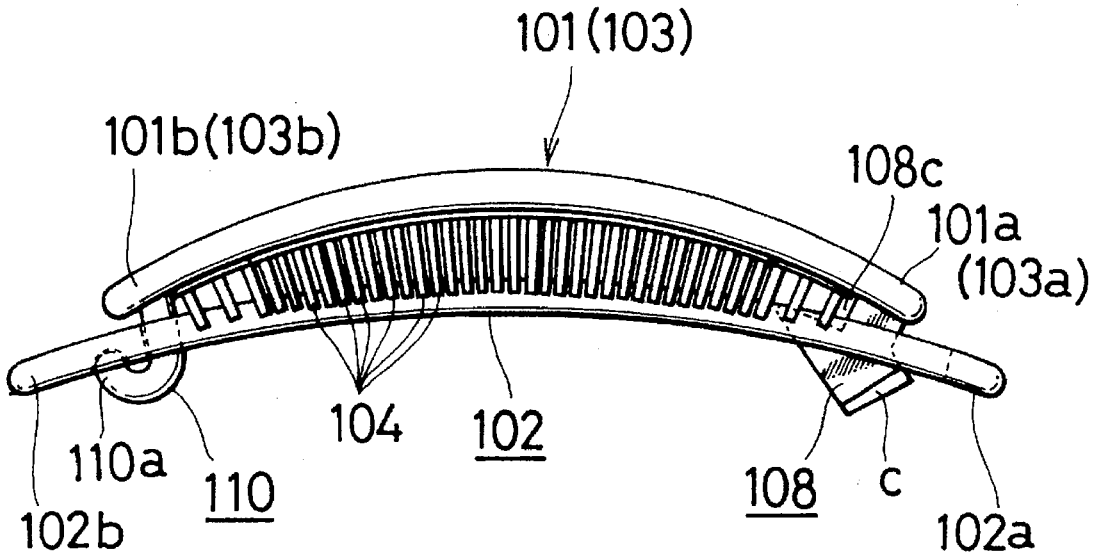
FIG. 15 is a front elevation of the hair clip shown in FIG. 14, in which a lockable member of the hair retainer is in engagement with a locking member of the base plate shown in FIG. 14.

As shown in FIG. 15, the hair retainer at the retracted position will be displaced a small distance to the right so that the one end 102*b* of said retainer is caught by the locking member 110. This end 102*b* will be made free by moving the hair retainer 102 in a reverse direction.

A small and shallow recess 'u' may be formed in the back side surface of the hair retainer. This recess 'u' engageable with the tip end of said locking member 110 renders stabler the retracted position of said retainer 102.

The connector 108 has a lower oblique edge integral with outer lugs 'c' and 'c'. These lugs 'c' protrude sideways beyond lateral and parallel edges of the slot 'S' so as to be cooperable with the base plate's edge. The hair 102 retainer having one end unlocked from the member 110 will have the other end jammed between the lugs and the plate's edge, thus being prevented to swing and open beyond a given angular limit relative to the base plate 101. Such a limited swinging of the hair retainer allows this hair clip to be easily and surely attached to the user's hair.

Figure 16:
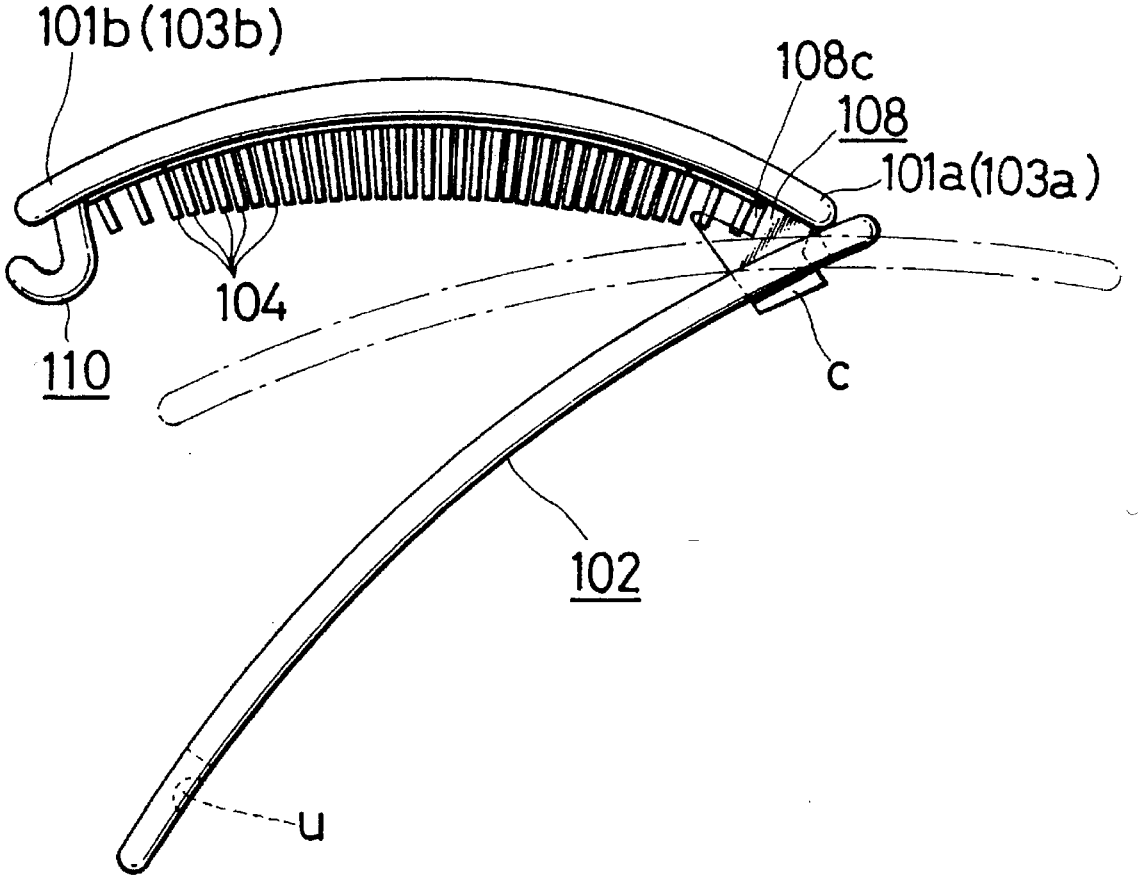
FIG. 16 is a front elevation of the hair clip shown in FIG. 14, with its hair retainer being hindered from rocking beyond an angular limit relative to the base plate shown in FIG. 14.
Figure 18:
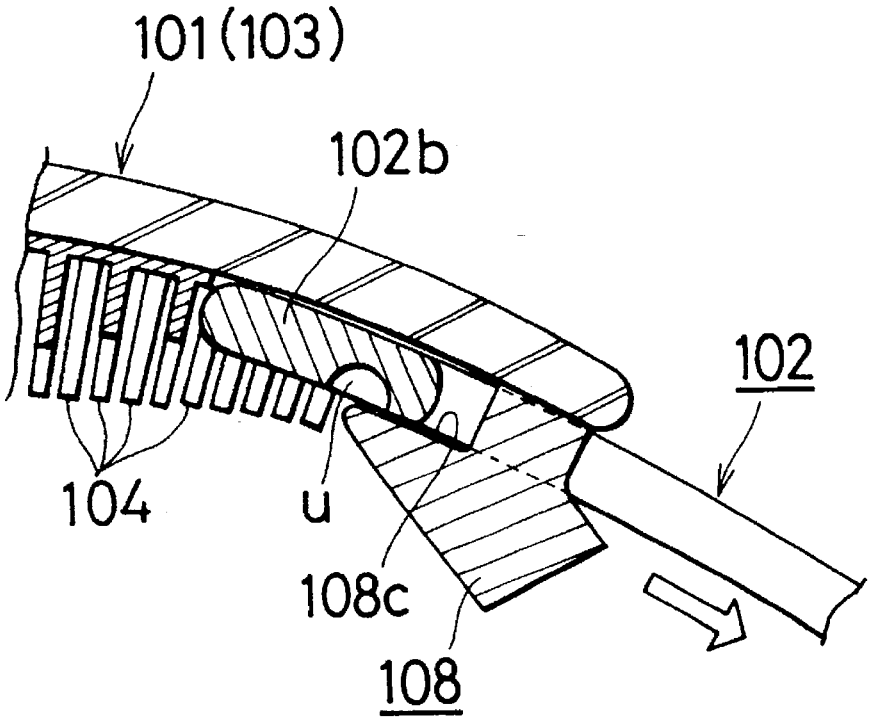
FIG. 18 is an enlarged cross section of the hair retainer which is being locked to the base plate shown in FIG. 14.

Thanks to the sliding engagement of the slot 'S' with the connector 108, the hair retainer 102 can move to the right in FIG. 16, so as to take its semi-extended position indicated at the dot-and-dash and then its almost fully extended position shown in FIG. 18. The hair retainer 102 at the latter position overlaps only at its one end 102*b* with the base plate, with the major part protruding out of this plate 101.

Figure 17:
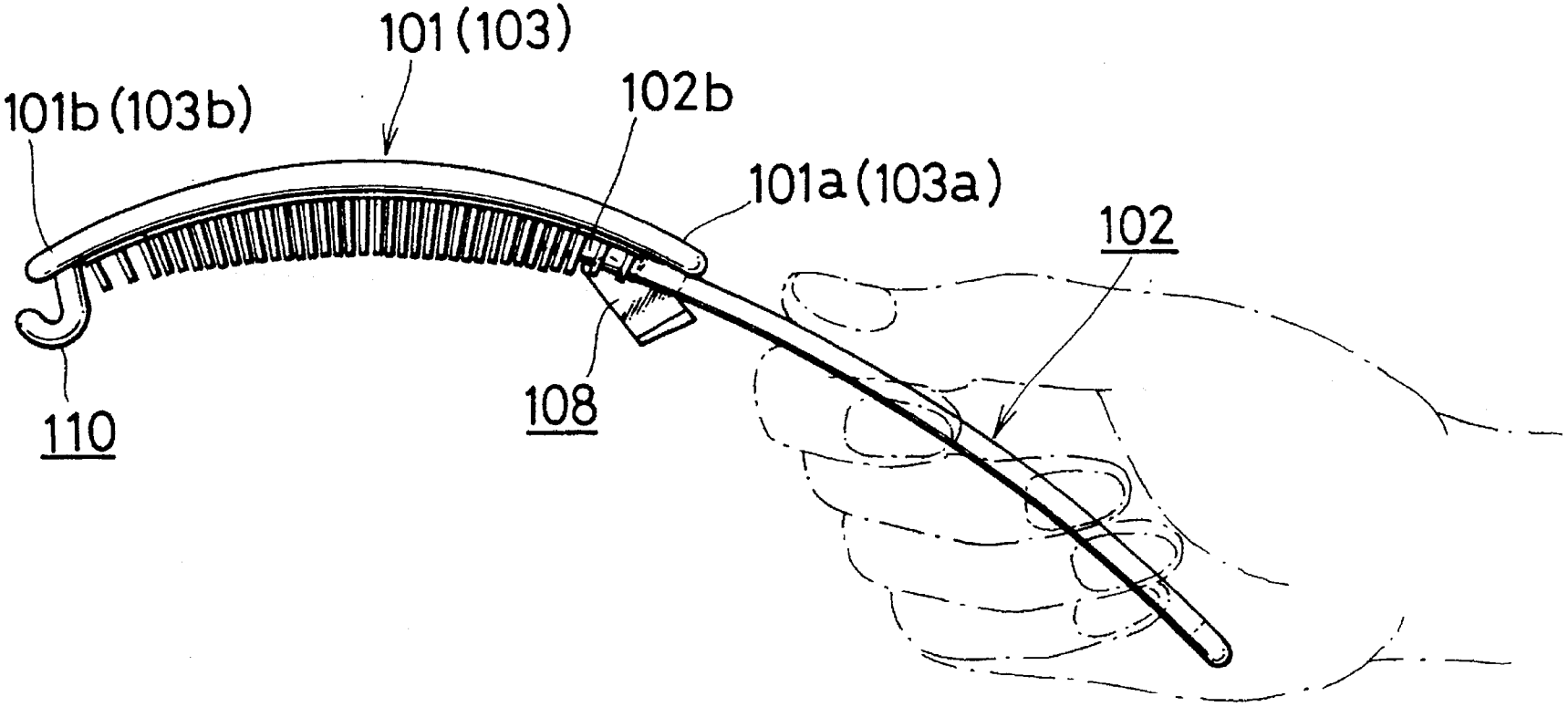
FIG. 17 is also a front elevation of the hair clip, wherein its hair retainer shown in FIG. 14 has slided towards one end of the base plate and then locked thereto.
Figure 19:
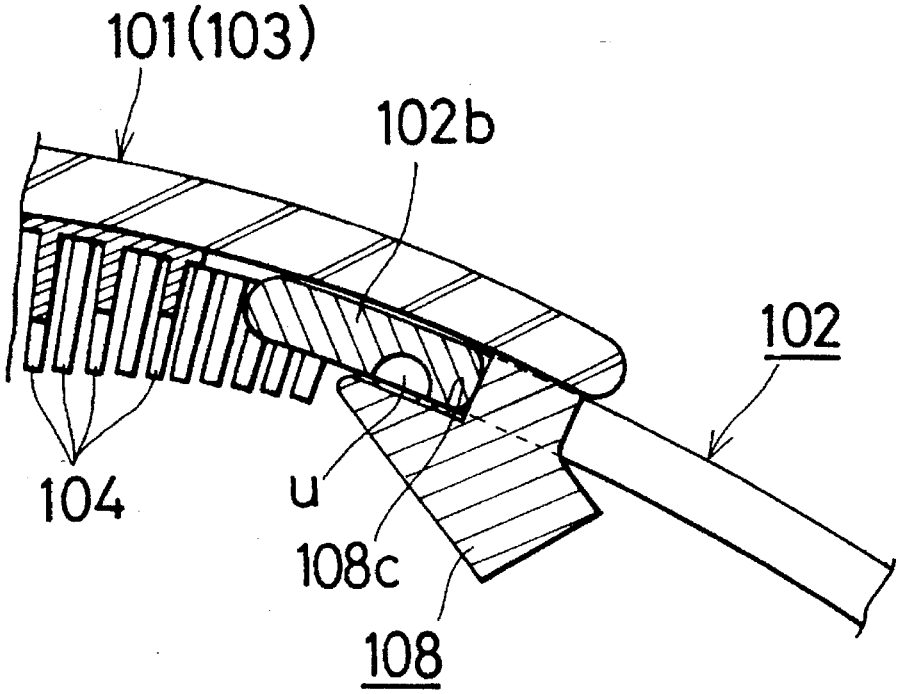
FIG. 19 is an enlarged cross section corresponding to FIG. 18 but showing the hair retainer which has been locked to the base plate.

The hair retainer 102 taking the position shown in FIG. 18 will further be moved to the right to take the fully extended position shown in FIG. 17 and 19. A recess 108*c* formed in a basal and inner portion of the connector 108 permits the hair retainer to make such an additional movement to the right in the drawings so as to be locked unrockable in any direction. The hair retainer 102 can be unlocked from the base plate 101 and returned to the position shown in FIG. 18, by reverse displacement (to the left) of the former relative to the latter. In order to facilitate the locking and unlocking operation, no comb-tooth-shaped lugs 104*a* are located near the connector 108.

With the hair retainer being extended and locked, the plurality 104 of comb-tooth-shaped lugs 104*a* will serve as a hair brush, and the hair retainer will be used as a handgrip therefor.

It will now be apparent that the hair clip having its base plate 101 cooperating with the hair retainer 102 can be held in place not to move or skew on the user's hair, by virtue of entanglement thereof with the plurality 104 of comb-tooth-shaped lugs 104*a*.

Any modification of the exemplified embodiments may be included in this invention, insofar as it falls within the scope defined with the accompanying claims.

What is claimed is:

1. Hair clip comprising:

a base plate having opposite ends;

means pivotally attached to one end of the base plate for dually functioning as a handle to grip in order to use said hair clip as a hair brush or comb when a free end of said means is pivoted away from said base plate and for functioning as a hair retainer to retain hair against said base plate when said free end of said means is pivoted toward said base plate so that said means and said base plate are adjacent each other and approximately parallel to each other; and a number of comb-tooth-shaped lugs protruding from a back surface of the base plate;

wherein said base plate has a locking member at said second end and said handle and retainer means has a lockable member which corresponds to and is matable with said locking member;

wherein the base plate has at the other end a locking member, and the hair retainer has a lockable member corresponding to the locking member; and wherein the lockable member of the hair retainer pivoted to the one end of the base plate, is displaceable a distance in opposite directions longitudinally of the base plate, so that the locking member can lock onto the lockable member when the lockable member of the hair retainer is displaced towards the one end of the base plate, and release the lockable member when the lockable member of the hair retainer is displaced away from the one end of said base plate.

2. The hair clip as defined in claim 1, wherein said base plate substantially consists of an ornamental cover made of a hard plastic material.

3. The hair clip as defined in claim 1, wherein said angle at which said hair clip is open when said handle and retainer means is pivoted through an angle of approximately 180° from said base plate and said base plate is substantially flush with said handle and retainer means, and said handle and retainer means is prevented, by abutment of said first end of said base plate and said first end of said handle and retainer means, from further swinging beyond said 180° angle.

4. The clip as defined in claim 1, wherein the base plate has a pivoting member at the one end, the pivoting member comprises slots extending longitudinally of the base plate, and the hair retainer has at an end corresponding to the one end of the base plate a shaft inserted in the slots, and wherein the locking member has a hook facing the other end of the base plate, and the lockable member of the hair retainer comprises bulged portions protruding towards the base plate and a transverse tie bar connecting summits of the bulged portions to each other.

5. The hair clip as defined in claim 1, wherein said hook of said locking member at said second end of said base plate does not protrude perpendicularly outwardly from said back surface of said base plate as far as do said comb-tooth-shaped lugs.

6. The hair clip as defined in claim 1, wherein an anti-slip mat is disposed adjacent to basal ends of said comb-tooth-shaped lugs, said mat being made of a frictional material from a group consisting of rubber or soft plastic and said frictional material covering substantially all of said back surface of said base plate.

7. The hair clip as defined in claim 1, wherein said comb-tooth-shaped lugs are arranged in a plurality of rows.

8. The hair clip as defined in claim 1, wherein said comb-tooth-shaped lugs form a single row.

9. Hair clip comprising:

a base plate having opposite ends;

a hair retainer pivoted to the base plate at the one end thereof;

a locking member disposed at the other end of the base plate;

a lockable member possessed by the hair retainer at a portion thereof corresponding to the locking member, so that the lockable member of the hair retainer is displaceable a distance in opposite directions longitudinally of the base plate in order for the locking member to lock on the lockable member when the lockable member of the hair retainer is displaced towards the one end, and release the lockable member when the lockable member of the hair retainer is displaced away from the one end of said base plate; and a number of comb-tooth-shaped lugs resembling as a whole a hair brush and protruding from a back surface of the base plate, wherein the hair retainer is swingable to be opened at an angle substantially flush with the base plate, and the hair retainer is prevented, by the abutment of the base plate and the hair retainer, from further swinging beyond the angle.

10. Hair clip comprising:

a base plate;

upright legs protruding from and perpendicular to the base plate;

a hair retainer having a basal end with arms and a shaft secured thereto and pivoted to the upright legs at one end of the base plate;

a locking member formed at and integral with the other end of the base plate;

a lockable member formed at and integral with the other end of the hair retainer;

the lockable member capable of engaging with and disengaging from the locking member;

a plurality of comb-tooth-shaped lugs secured to a back surface of the base plate;

wherein the hair retainer is reversibly swingable away from the base plate up to a limit angle by the abutment of a bulged portion of each of the arms at the one end of the hair retainer and the one end of the base plate where the hair retainer and the base plate are included in substantially the same plane;

a lock mechanism comprising recesses for a sliding engagement with the basal end of the hair retainer; and the recesses being formed in basal portions of the upright legs and partially defined with a back surface of the base plate so as to open towards the aforementioned one end thereof and extend a distance along the base plate, such that the basal end of the hair retainer pivoted to the base plate is capable of sliding towards the base plate when included in substantially the same plane as the base plate, until the basal end comes into a full engagement with the recesses so as to inhibit the hair retainer from swinging relative to the base plate.

11. Hair clip as defined in claim 10, wherein the lockable member of the hair retainer engages with the locking member of the base plate when the hair retainer is swung towards one end of the base plate, and the lockable member disengages from the locking member when the hair retainer is swung towards the other end of the base plate.

12. Hair clip as defined in claim 10, wherein said bulged portions of the arms of the basal end of the hair retainer bears against a portion of the base plate located near the haft of said hair retainer, so that the hair retainer is inhibited from further swinging, when and after the hair retainer has swung from a closed position where the lockable member is locked onto the locking member and the hair retainer is located approximately flush with the base side of the base plate.

13. Hair clip comprising:

a base plate;

a plurality of comb-tooth-shaped lugs secured to a back surface of the base plate;

a hair retainer for cooperation with the base plate to grip human hair;

a connector protruding from the back surface and integral with one end of the base plate;

the connector unremovably engaging with the hair retainer;

a locking member formed at and integral with the other end of the base plate so as to fix thereto one end of the hair retainer;

a slot formed in and along the hair retainer;

the slot being intermediate lateral edges of said hair retainer;

the connector being held in engagement with the slot such that the hair retainer is slidable between a retracted position and an extended position, wherein the retainer fully overlaps with the base plate at the retracted position and fully extends outwardly from one end of the base plat at the extended position; and a recess formed in the connector such that the one end of the hair retainer taking the extended position is locked in place not to swing relative to the base plate and wherein the connector has integral therewith outer lugs protruding sideways beyond lateral and parallel edges of the slot, so that the lugs cooperate with an edge of the base plate to thereby prevent the hair retainer from rocking beyond an angular limit relative to the base plate.

* * * * *